US006968950B2

(12) United States Patent
Eisenbraun

(10) Patent No.: US 6,968,950 B2
(45) Date of Patent: Nov. 29, 2005

(54) INTERACTIVE MERCHANDISING PACKAGING

(75) Inventor: Kenneth D. Eisenbraun, Bloomfield Village, MI (US)

(73) Assignee: United Global Sourcing, Inc., Troy, MI (US)

( * ) Notice: Subject to any disclaimer, the term of this patent is extended or adjusted under 35 U.S.C. 154(b) by 0 days.

(21) Appl. No.: 10/401,440

(22) Filed: Mar. 28, 2003

(65) Prior Publication Data

US 2004/0149615 A1 Aug. 5, 2004

Related U.S. Application Data

(60) Provisional application No. 60/443,687, filed on Jan. 30, 2003.

(51) Int. Cl.[7] ..... B65D 75/36; B65D 73/00; B65D 85/00

(52) U.S. Cl. ..... 206/461; 206/471; 206/703

(58) Field of Search ..... 206/495, 461, 206/471, 485, 703, 705, 338, 775, 459.5

(56) References Cited

U.S. PATENT DOCUMENTS

| | | | | |
|---|---|---|---|---|
| 2,085,414 A | | 7/1937 | Cavanagh | |
| 2,475,450 A | | 7/1949 | Dvorak | |
| 3,061,080 A | * | 10/1962 | Stephen | 206/338 |
| 3,297,289 A | * | 1/1967 | La Raus | 248/152 |
| 3,703,234 A | | 11/1972 | Howard | 206/78 |
| 4,546,879 A | * | 10/1985 | Viscasillas | 206/391 |
| 4,637,516 A | * | 1/1987 | de Roure | 206/471 |
| 4,702,374 A | * | 10/1987 | Kelner | 206/418 |
| 4,899,877 A | * | 2/1990 | Kiernan | 206/349 |
| 5,501,020 A | | 3/1996 | Welt | 33/555.2 |
| 5,755,323 A | | 5/1998 | Zahn et al. | 206/318 |
| 6,241,092 B1 | * | 6/2001 | Vasudeva | 206/349 |
| 6,349,830 B1 | | 2/2002 | Lebron | 206/461 |
| 2003/0052033 A1 | * | 3/2003 | Schwester | 206/461 |
| 2003/0205500 A1 | * | 11/2003 | Schein et al. | 206/705 |

* cited by examiner

*Primary Examiner*—Mickey Yu
*Assistant Examiner*—J. Gregory Pickett
(74) *Attorney, Agent, or Firm*—Gifford, Krass, Groh, Sprinkle, Anderson & Citkowski, P.C.

(57) ABSTRACT

The present invention provides an interactive merchandising packaging that includes at least one opening formed therein whereby a user can test the utility of the packaged product with items external to the packaging without removing the product from the packaging. The at least one opening is dimensioned such that only a portion of the product is accessible for interacting with an external object and removal of the product is prohibited without causing damage to the packaging.

4 Claims, 2 Drawing Sheets

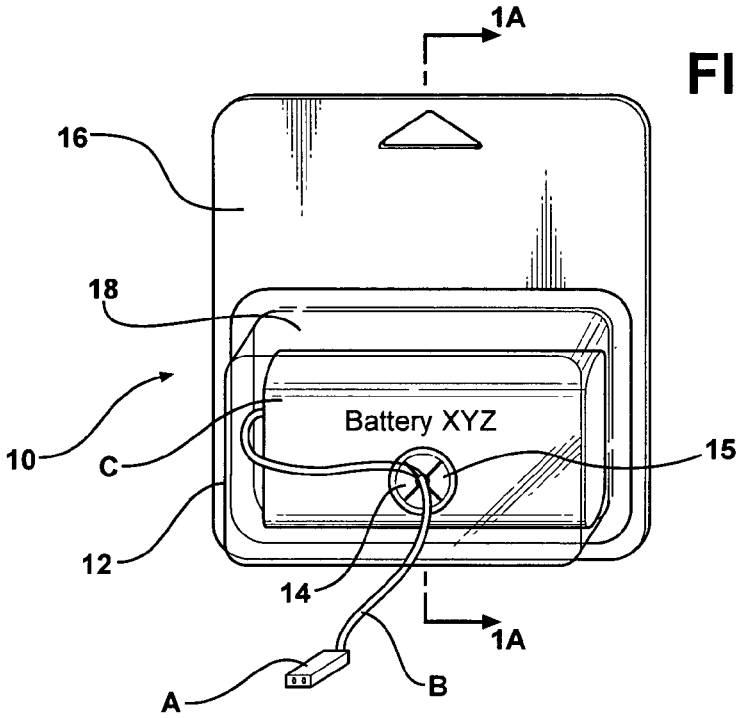
FIG - 1A
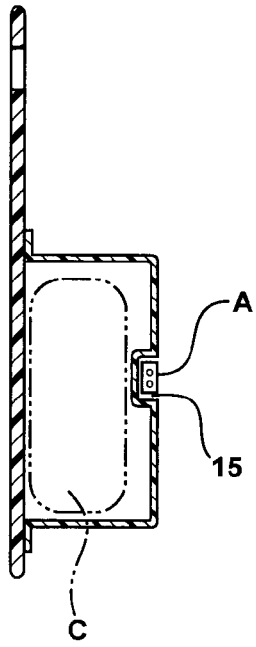
FIG - 1B
FIG - 2
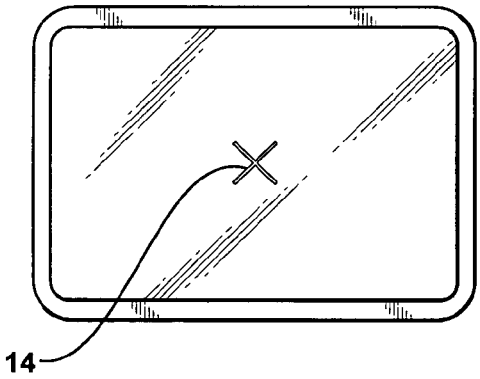
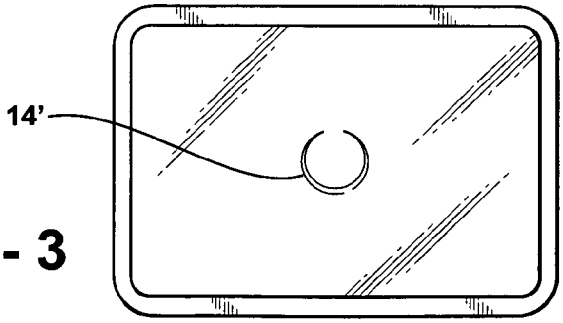
FIG - 3

FIG - 4
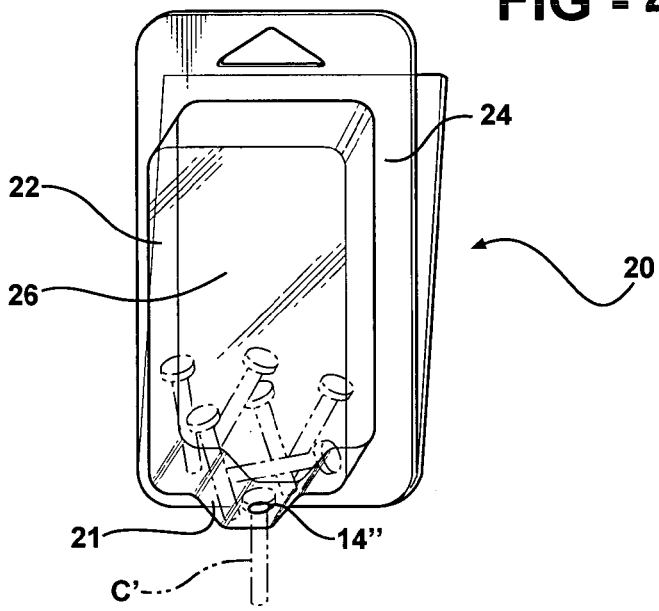
FIG - 5A
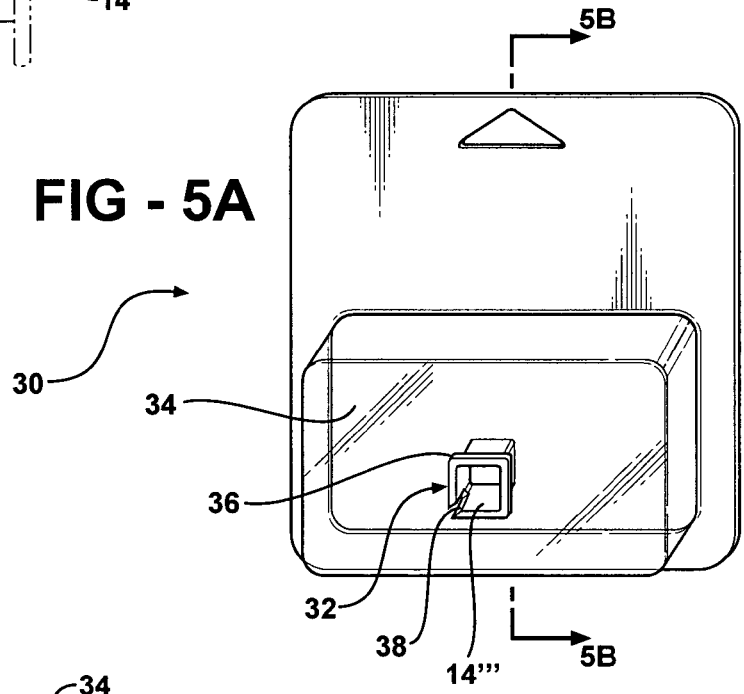
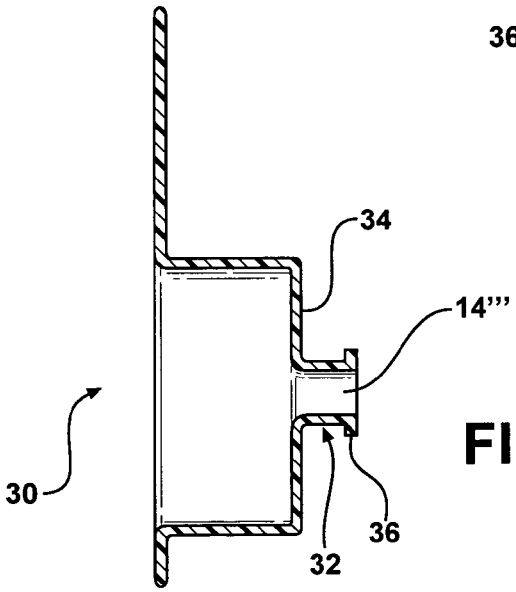
FIG - 5B

INTERACTIVE MERCHANDISING PACKAGING

RELATED APPLICATION

This application claims priority of U.S. Provisional Patent Application Ser. No. 60/443,687 filed Jan. 30, 2003, which is incorporated herein by reference.

FIELD OF INVENTION

The present invention relates to packaging for products and more particularly to a product packaging that includes an opening that allows the user to determine the suitability of the product relative to cooperating with an object external to the packaging.

BACKGROUND OF THE INVENTION

Many times consumers enter stores to purchase hardware fittings, product accessories, tools or other products that are designed for specific applications. Under such circumstances problems frequently arise when the consumer is not exactly sure which product he or she should purchase to satisfy his or her needs. As a result, the consumer sometimes purchases one or more of the product that the consumer thinks will suit his or her needs, takes the product to the location where the product is to be used, then opens the package the product is contained in only to find out that the product selected does not satisfy his or her needs.

Many merchants require that in order for the consumer to receive a full refund or to process an exchange, the consumer must return the product to the store in a resellable condition. This sometimes includes ensuring that the product be repackaged in the original container such that the product does not become damaged and, most importantly to the merchant, that the previously opened and resealed container or packaging doesn't discourage other consumers from buying the product in such condition. Nevertheless, in many cases the merchant is forced to sell the repackaged product at a reduced price or risk not selling the product at all.

SUMMARY OF THE INVENTION

The present invention provides an interactive merchandising packaging for a product whereby a user can test the utility of the packaged product with items external to the packaging without removing the product from the packaging. The interactive merchandising packaging as according to the invention comprises a wall having an opening formed therein. The opening is operative to provide the user access to at least a portion of the product for determining the suitability of the product in relation to the product's compatibility with an object external to the packaging. Thus, a user is allowed to interact with the packaged product independent of breaching the integrity of the packaging.

BRIEF DESCRIPTION OF THE DRAWINGS

A better understanding of the present invention will be had upon reference to the following detailed description when read in conjunction with the accompanying drawings in which like parts are given like reference numerals and wherein:

FIG. 1A is a perspective view of the interactive merchandising packaging as according to the invention;

FIG. 1B is a cross-sectional view of the packaging of FIG. 1A along the axis Y—Y;

FIG. 2 is a frontal view of an interactive blister portion of the packaging shown in FIG. 1;

FIG. 3 is a frontal view of an alternate embodiment of an interactive blister portion according to the present invention;

FIG. 4 is a perspective view of an alternative embodiment of an interactive blister portion according to the present invention having a protruding portion having an access opening therein;

FIG. 5A is a perspective view of an alternative embodiment of an interactive blister portion according to the present invention having a spool and storage recess formed into a protrusion having an access opening therein; and FIG. 5B is a cross-sectional view of the packaging of FIG. 5A along the axis Z–Z'.

DESCRIPTION OF THE INVENTION

To overcome the above-described disadvantages to consumers and merchants relative to product packaging and repackaging, the present invention provides an interactive merchandising packaging that allows a consumer to determine if the packaged product will satisfy his or her particular needs without removing the product from its sealed packaging. In this manner the consumer does not have the burden of repackaging the product before returning to the store for refund or exchange while the merchant does not have to contend with selling the repackaged product at a reduced price or not at all.

The interactive merchandising packaging according to the invention comprises a packaging wall that includes at least one opening formed therein whereby a user can test the utility of the packaged product with items external to the packaging without removing the product from the packaging.

It is appreciated that the design of the interactive merchandising packaging may vary to accommodate the product contained therein such that the inventive concept described herein and the advantages over conventional packaging are realized by merchants and consumers.

FIG. 1 exemplifies a first embodiment of an interactive merchandising packaging 10 well suited for a packaged product, such as for a cordless phone battery C in communication with a terminal connector A via electrical conductors B extending therebetween.

The inventive interactive merchandising packaging 10 illustrated includes a first packaging portion 12 detachably fixed to a second packaging portion 16 such that a product C can be disposed within an interior volume 18 defined by the combined first and second packaging portions 12 and 16. Preferably, the first packaging portion 12 is a blister package molding. The second packaging portion illustratively includes a cardboard backing, a complementary blister molded portion, or other conventional packaging support. More preferably, an inventive package 10 is capable of hang supporting a product C enclosed therein. Optionally, printed indicia (not shown) alert a user of the ability to test compatibility absent violating package integrity. Although the interactive merchandising packaging 10 illustrated here is comprised of two portions, it is appreciated that the combination of separate portions is not intended as a limitation on the inventive concept.

The interactive merchandising packaging 10 may be an integrally formed single material package wall that includes at least one access opening for interacting with the product. The packaging can be formed of any suitable material known to those skilled in the art which may illustratively include plastic, paper, or cardboard. Preferably, the package wall has a spaced portion defining a face therebetween with an access opening situated in the spaced portion or alternatively, in the face interconnecting the wall with spaced portion. An access opening situated in a spaced portion or face is strengthened against package tearing relative to an opening in a planar package wall. Preferably, the spaced portion is sized to accommodate a terminal connector or product portion for testing within the profile of the inventive interactive merchandising packaging. As used, "spaced portion" is defined to include a recessed or protruding portion that is outside of the plane of an adjacent packaging wall. By way of example, a terminal is protected during transit and handling within a recess, as shown in FIGS. 1A and 1B; a fastener is gravity fed into a protrusion for consumer testing, as shown in FIG. 4; or an electrical lead is wrapped about a hollow protrusion with the volume of the protrusion sized to accommodate a packaged product fitting or terminal, as shown in FIGS. 5A and 5B.

In FIGS. 1A and 1B, the first packaging portion 12 includes an opening 14 disposed therein that allows for the terminal connector A of the cordless phone battery C to be passed therethrough. This feature obviates the need for breaching the integrity of the seal between packaging portions 12 and 16 for the purpose of determining if the product C can be coupled to a complementary connector disposed at a portable phone. FIGS. 2 and 3 illustrate the opening 14 as being a crosshair cut and a flapped cutout 14', respectively. Other forms of the opening may illustratively include a resealable flap, a complete cutout, a resilient grommet type opening, or a slit. Preferably, the opening is dimensioned such that only a portion of the product is accessible for interacting with an external object and removal of the product from the packaging is prohibited without causing damage to the packaging.

Although FIG. 1 illustrates an interactive merchandising packaging containing a portable phone battery, it is appreciated that the present invention is operative with a variety of products which may include, but are not limited to, fastening hardware; product accessories; electrical/electronic components; hand tools; washers; automotive parts; appliance parts; pipe fittings or other apparatus and devices that can be packaged in the interactive merchandising packaging 10 such that a portion of the product may be made accessible to the consumer for determining if the product cooperates with an external object such that the packaging need not be opened.

FIG. 4 illustrates another embodiment wherein the inventive interactive merchandising packaging contains threaded fasteners C'. The interactive merchandising packaging shown generally at 20 includes an opening 14" that permits the threaded shaft of at least one fastener to extend outside the package such that a user may determine if the fastener will properly engage a complementary threaded nut external to the packaging. Preferably, a spaced portion 21 is formed as a protrusion with the opening 14" at the base thereof so a fastener is gravity fed therethrough. The packaging 20 includes a transparent blister portion 22 that folds against an integral rear wall portion 24. Thermal fusion, an adhesive label, polymer adhesives or other conventional package seals are applied to create an integral seal retaining the article C' within a volume 26 of the packaging 20.

FIG. 5 illustrates an inventive blister section embodiment generally at 30 where a spaced portion forms a hollow protrusion 32 that extends from a package wall 34. The protrusion 32 has a lip 36 and an opening 14'" to accommodate a product electrical lead passing therethrough and capable of being wrapped about the protrusion 32. Preferably, a notch 38 is provided in the protrusion 32 to receive a terminal within the hollow protrusion volume.

As illustratively described above, the inventive interactive merchandising packaging comprises a packaging portion separating an enclosed product from the external environment while providing an opening for testing whether the enclosed product successfully mates with an object external to the package without violating the integrity of the packaging in the process. It is appreciated that the design of the inventive packaging will be influenced by the product to be contained therein. Accordingly, other packaging designs may become apparent to those skilled in the art without exceeding the scope of the invention.

I claim:

1. An interactive package for an electrical device including a body and a connector joined to the body by a flexible electric conductor, the conductor being connected in circuit with the electrical device, comprising:

a planar backing sheet;

a blister package having its edges fixed to one side of the backing sheet to form a volume bounded on one side by the backing sheet and having a planar forward wall, spaced from the backing sheet;

a recess in said forward wall directed toward the backing sheet; and said electrical device packaged in the volume with the flexible conductor extending through an aperture in the blister package with the connector disposed in the recess, exteriorly of the closed volume;

whereby the electrical device may be joined to an additional device through the connector to test compatibility between the electrical device and the additional device without destroying the integrity of the interactive package, and the interactive package does not extend beyond the plane of said planar forward wall of the blister package.

2. The interactive package of claim 1 wherein the electrical device constitutes a battery.

3. The interactive package of claim 1 wherein the blister package is transparent and the backing sheet is opaque.

4. The interactive package of claim 1 wherein the flexible electrical conductor has a sufficient length to allow the connector to be removed from the recess for connection to an additional device.

* * * * *